United States Patent [19]

Ito et al.

[11] Patent Number: 4,732,565

[45] Date of Patent: Mar. 22, 1988

[54] ELECTRIC CONNECTOR

[75] Inventors: Michio Ito, Tokyo; Eiji Matsuda, Yokohama; Tetsuya Kaneko, Tokyo, all of Japan

[73] Assignee: MG Company, Ltd., Miyagi, Japan

[21] Appl. No.: 865,041

[22] Filed: May 19, 1986

[30] Foreign Application Priority Data

| | | | |
|---|---|---|---|
| May 28, 1985 | [JP] | Japan | 60-78612[U] |
| Sep. 14, 1985 | [JP] | Japan | 60-203973 |
| Nov. 1, 1985 | [JP] | Japan | 60-245930 |
| Nov. 5, 1985 | [JP] | Japan | 60-247699 |

[51] Int. Cl.[4] ..... H01R 23/70

[52] U.S. Cl. ..... 439/79; 439/83

[58] Field of Search ..... 339/17 R, 17 C, 17 LC, 339/17 L, 17 LM, 17 M, 176 M, 176 MP; 439/79–83, 629

[56] References Cited

U.S. PATENT DOCUMENTS

| | | | |
|---|---|---|---|
| 3,493,916 | 2/1970 | Hansen | 339/17 |
| 3,636,503 | 1/1972 | Bernutz | 339/17 LC |
| 3,864,000 | 2/1975 | Coller et al. | 339/17 LC |
| 4,196,957 | 4/1980 | Benasutti | 339/17 LC |
| 4,410,230 | 10/1983 | San Miguel | 339/17 LC |
| 4,509,811 | 4/1985 | Amano et al. | 339/17 LC |
| 4,612,602 | 9/1986 | Weyer et al. | 339/17 LC |
| 4,634,198 | 1/1987 | Rush | 339/17 LC |

FOREIGN PATENT DOCUMENTS

| | | | |
|---|---|---|---|
| 1364127 | 5/1964 | France | 339/17 LC |
| 1032414 | 6/1966 | United Kingdom | 339/17 L |

OTHER PUBLICATIONS

IBM Bulletin, Schick, vol. 7, No. 1, p. 91, 6–1964.

Electronic Engineering, ITT Canon Surface Mount the Connector, p. 15, 8–1984.

*Primary Examiner*—Neil Abrams

*Attorney, Agent, or Firm*—Rosen, Dainow & Jacobs

[57] ABSTRACT

An electric connector for electrically connecting between an electric element and conductors on a printed circuit board comprises a plastic main body and a plurality of conductor members penetrating the main body. Each conductor members has a connecting portion for connecting to the electric element and a terminal portion for connecting to one conductor on the printed circuit board. Each terminal portion of the conductor members has a first face which contacts with one conductor on the printed circuit board when the electric connector is arranged on the printed circuit board so that each connecting portion of the conductor members extends parallel to the printed circuit board and a second face which contacts with one conductor on the printed circuit board when the electric connector is arranged on the printed circuit board so that each connecting portion of the conductor members extends perpendicularly to the printed circuit board. The main body has surface grooves for accommodating therein the ends of the terminal portions of the conductor members.

13 Claims, 31 Drawing Figures

Fig. 8
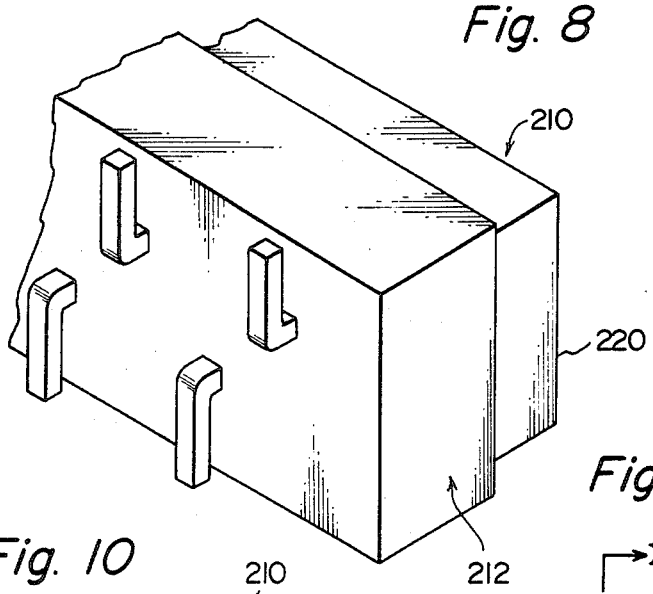
Fig. 9
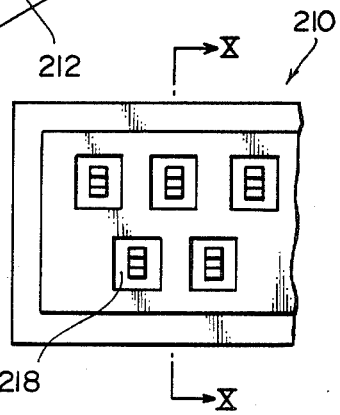
Fig. 10
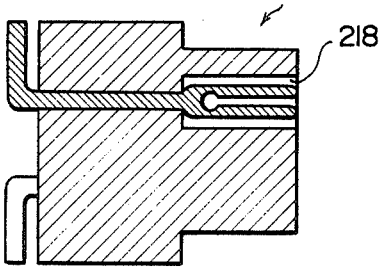
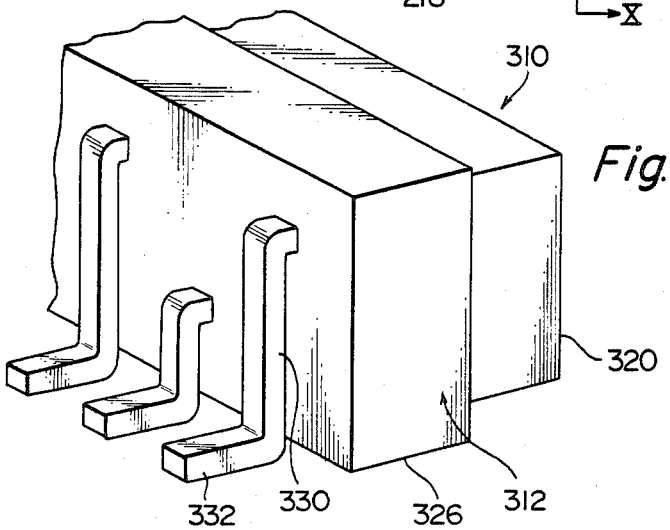
Fig. 11

Fig. 15
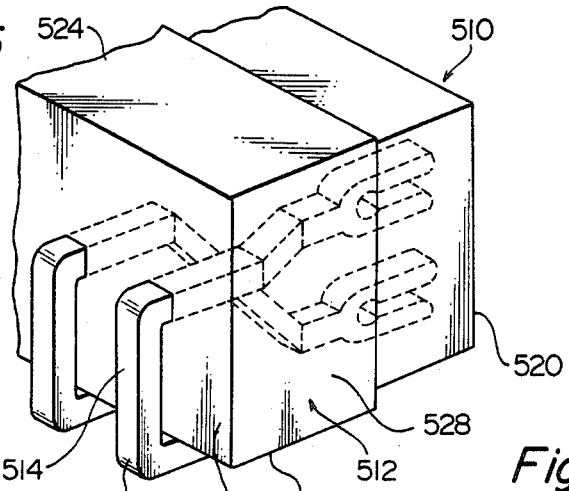
Fig. 16
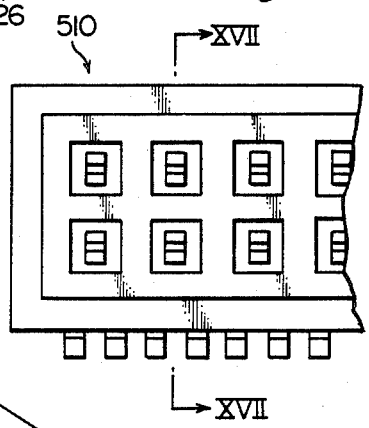
Fig. 17
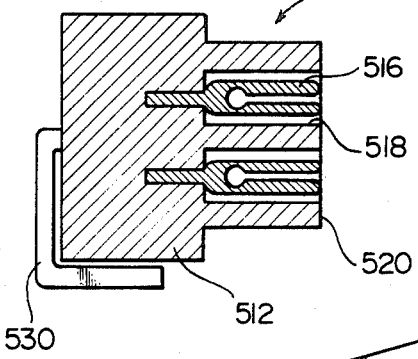
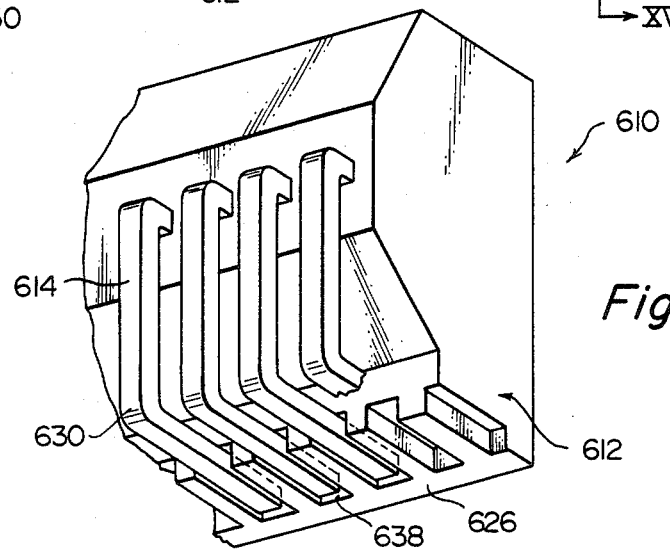
Fig. 18

ELECTRIC CONNECTOR

BACKGROUND OF THE INVENTION

1. Field of the Invention

This invention relates to electric connectors. More particularly, the present invention relates to electric connectors such as a pin header, a plug and the like, to be connected at one end to an electric element and to be soldered at the other end to conductors on a printed circuit board.

2. Description of the Prior Art

Conventional electric connectors are largely divided into two types. One type is pin headers having male contacts and the other type is plugs having female contacts.

As the conventional pin headers, there are known those having one side constituting male contacts and the other side constituting terminal portions to pass through holes of a printed circuit board and to be soldered to conductors on the back side of the printed circuit board. Also as the conventional plugs, there are known those having a similar structure to that of the conventional pin headers.

Thus, in the conventional pin headers and plugs, the terminal portions are to pass through the holes of a printed circuit board. This causes various problems. That is, a relatively large surface area is required for the printed circuit board; the dimensions of the holes of the printed circuit board are limited and the distance between the holes can not be made sufficiently small; consequently, the shape of pin header or plug is restricted and their size can not be made sufficiently small; hence, a general requirement of making an intended equipment compact can not be met. Further, fixing of such a pin header or plug is fairly troublesome.

SUMMARY OF THE INVENTION

In order to solve the above problems, there is provided, according to the present invention, an electric connector for electrically connecting (1) an electric element and (2) conductors on a printed circuit board, which comprises a plastic main body and a plurality of conductor members penetrating the main body, each of the conductor members having a connecting portion for connecting to the electric element (1) and a terminal portion for connecting to one conductor (2) on the printed circuit board and each one subportion of the terminal portions being substantially on one same plane.

According to the present invention, there is further provided a process for producing an electric connector for electrically connecting (1) an electric element and (2) conductors on a printed circuit board, said electric connector comprising a plastic main body and a plurality of conductor members penetrating the main body, each of the conductor members having a connecting portion for connecting to the electric element (1) and a terminal portion for connecting to one conductor (2) on the printed circuit board and each one subportion of the terminal portions being substantially on one same plane, said process comprising preparing a main body from a plastic material, driving a plurality of conductor members into the main body, and bending each one end of the conductor members to form respective terminal portions.

Accordingly, an object of the present invention is to provide an electric connector which is compact and yet is low in the likelihood of electrical contact between the conductor members, as well as to a process for producing said electric connector.

Another object of the present invention is to provide an electric connector suitable for connecting to conductors on a printed circuit board, as well as to a process for producing said electric connector.

A further object of the present invention is to provide an electric connector whose connecting portions for connecting to an electric element are arranged so as to extend perpendicularly or parallel to the surface of a printed circuit board, as well as a process for producing said electric connector.

Still another object of the present invention is to provide an electric connector wherein the distance between any two adjacent terminal portions stays constant so as to allow the effective connection of the terminal portions to conductors on a printed circuit board, as well as a process for producing said electric connector.

BRIEF DESCRIPTION OF THE DRAWINGS

FIG. 8 is a key portion perspective view of a plug according to the sixth embodiment of the present invention.

FIG. 9 is a partial front view of the plug of FIG. 8.

FIG. 10 is a sectional view taken along the line X—X of FIG. 9.

FIG. 11 is a key portion perspective view of a plug according to the seventh embodiment of the present invention.

FIG. 15 is a key portion perspective view of a plug according to the ninth embodiment of the present invention.

FIG. 16 is a partial front view of the plug of FIG. 15.

FIG. 17 is a sectional view taken along the line XVII—XVII of FIG. 16.

FIG. 18 is a key portion perspective view of a plug according to the tenth embodiment of the present invention.

DESCRIPTION OF THE PREFERRED EMBODIMENTS

The preferred embodiments of the present invention will be explained by referring to the accompanying drawings.

The first embodiment of the present invention will be explained by referring to FIG. 1.

A pin header 10 as the first embodiment consists of (1) a main body 12 made from a plastic material which is electrically insulating and (2) a plurality of pins 14 made from a metallic material which is electroconductive.

Figure 1:
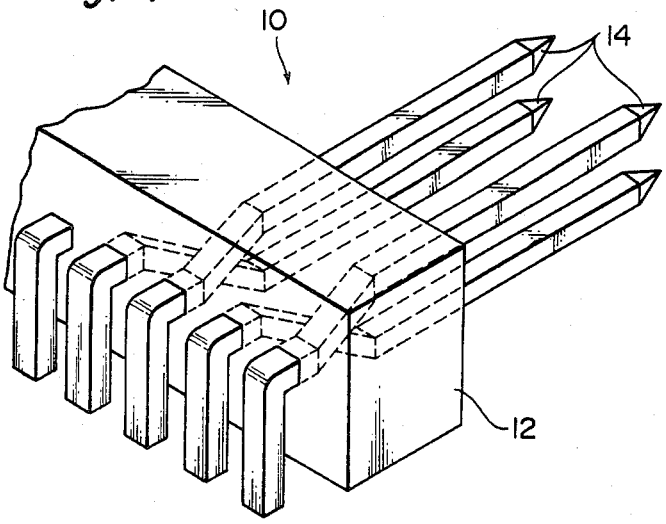
FIG. 1 is a key portion perspective view of a pin header according to the first embodiment of the present invention.

The main body 12 is preferred to be substantially a rectangular parallelepided as illustrated in FIG. 1. However, it can take various other shapes.

The pins 14 penetrate the main body 12 and, at the female connector side (the unseen back side of FIG. 1), further extend, for example, in two parallel straight rows as shown in FIG. 1 so as to be connected to the contact holes of a female connector (not shown). Needless to say, the pins 14 can be arranged in various other patterns depending upon the arrangement of the contact holes of the female connector to which the pins 14 are to be connected.

The pins 14 leave the main body 12 in one straight row at the printed circuit board side (the seen front side of FIG. 1) so as to be connected to a printed circuit board (not shown) and are then bent downward. The height at which the pins 14 leave the main body 12 at the printed circuit board side is same as the height of a middle point of the two parallel straight rows of the female connector side.

Accordingly, in the pin header 10 of FIG. 1, the pins 14 are curved within the main body 12. In this embodiment, all of the pins 14 are curved. However, it is possible that each pin of one row be straight and only the pins of the other row be curved within the main body.

The pin header 10 can be produced by, for example, molding the main body 12 and the pins 14 in one piece. That is, a plurality of pins are arranged appropriately in a mold and then a plastic material is poured thereinto to mold a pin header in one piece. Subsequently, the pins are bent in one same direction at the printed circuit board side of the header. Since these pins have the same length and shape before they are bent, pins of the same part can be used in this molding. If necessary, the pins can further be bent at the same side of the header to a direction moving away from the header so that the bottom faces of the pins parallel to the bottom face of the main body can be connected to the contacts of a printed circuit board.

This pin header 10 is fixed to, for example, a printed circuit board and the printed circuit board side ends of the pins 14 are soldered to the contacts on the printed circuit board. The female connector side ends of the pins 14 are fitted with the contact holes of a female connector, whereby the contacts on the printed circuit board and an electric equipment connected to the female connector are connected electrically.

Figure 2:
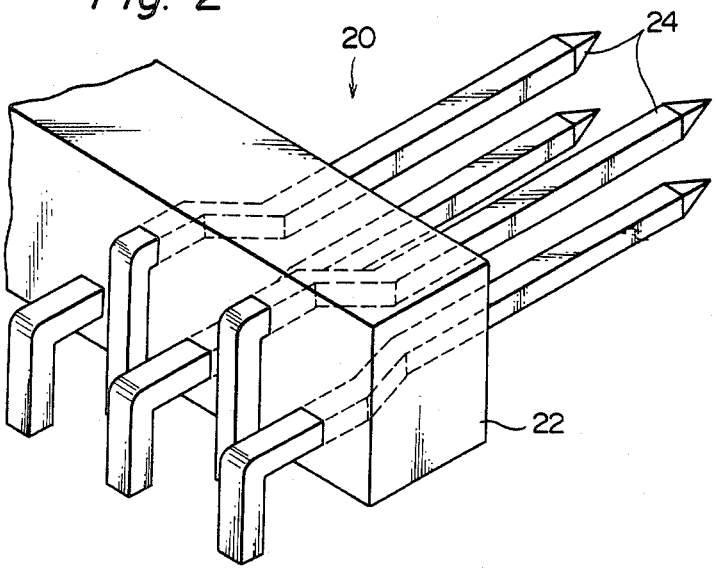
FIG. 2 is a key portion perspective view of a pin header according to the second embodiment of the present invention.

The second embodiment of the present invention will be explained by referring to FIG. 2.

A pin header 20 as the second embodiment consists, as in the case of the first embodiment, of a main body 22 made from a plastic material and a plurality of pins 24.

The pins 24 are arranged in two parallel straight rows at the female connector side.

The pins 24 project from the main body 22 in two parallel straight rows at the printed circuit board side in such a condition that any two adjacent pins of one row and a pin of the other row located nearest to said two adjacent pins always form an equilateral triangle. The pins 24 of the upper row each are bent downward at a position nearer to the main body 22, and the pins 24 of the lower row each are bent downward at a position further from the main body 22. Therefore, each final end of the pins 24 of the upper row is arranged so as to form a straight line along the main body 22 which is nearer to the main body 22, and each final end of the pins 24 of the lower row is arranged so as to form a straight line along the main body 22 which is further from the main body 22. In this embodiment, the pins 24 of the upper row and the pins 24 of the lower row have the same length also at the printed circuit board side. As in the first embodiment, since the pins of this embodiment have the same length and shape before they are bent, pins of the same part can be used.

When, as in conventional electric connectors, pins are arranged in two parallel straight rows (an upper row and a lower row) in such a condition that one pin of the upper row and one pin of the lower row are always on one same straight line perpendicular to the two parallel straight rows, the printed circuit board side ends of the pins are also arranged in said condition. This pin arrangement at the printed circuit board side, when combined with a small distance between the two parallel straight rows, may cause pin-to-pin contact. By contrast, in the pin header 20 of the second embodiment of the present invention, since the pins 24 project from the main body in two parallel straight rows at the printed circuit board side in such a condition that any two adjacent pins of one row and a pin of the other row located nearest to said two adjacent pins always form an equilateral triangle and accordingly the printed circuit board side ends of these pins 24 are also arranged in the same condition, there is little fear of pin-to-pin contact.

According to the first and second embodiments of the present invention, the pins are curved and can be crossed within the main body. As a result, undesirable electrical contact between the pins can be prevented.

Further, according to the first and second embodiments of the present invention, the printed circuit board side positions of the pins can be determined independently from the female connector side positions of the pins. For example, the pins can be arranged at the printed circuit board side in two parallel straight rows in such a condition that (1) only one pin of any row is present on a straight line perpendicular to the rows and (2) the distance between the two parallel straight rows is small. Even in this pin arrangement at the printed circuit board side, there is little fear of pin-to-pin contact.

A pin header 30 as the third embodiment of the present invention will be explained by referring to FIG. 3.

The pin header 30 comprises a main body 32 made from a plastic material and a plurality of pins 34 penetrating the main body 32.

Figure 3:
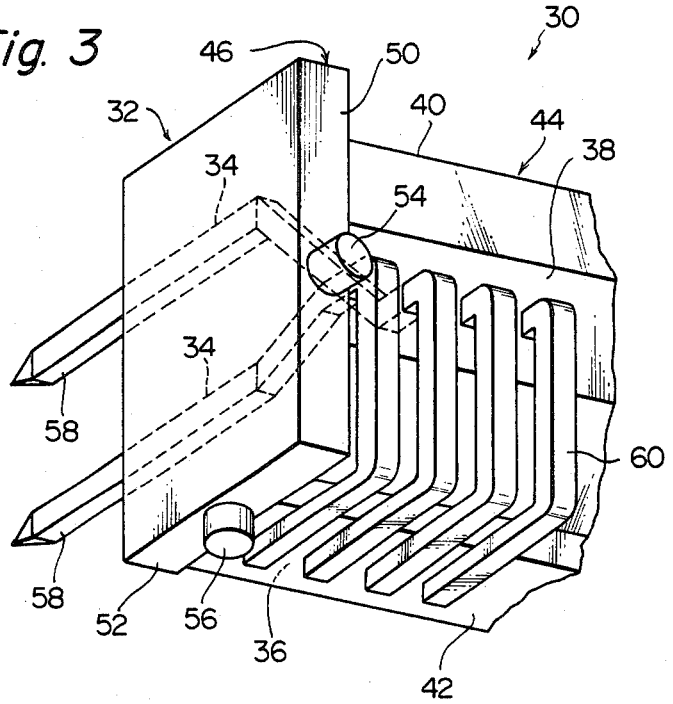
FIG. 3 is a key portion perspective view of a pin header according to the third embodiment of the present invention.

The main body 32 has a main portion 44 defined by a substantially rectangular and flat front face 36, a back face 38 opposing the front face 36, an upper face 40, a bottom face 42, etc., as well as two side portions 46 (only one of them are shown in FIG. 3). The main portion 44 is substantially trapezoidal similarly to a main portion 124 of FIG. 4. However, unlike the main portion 124 of FIG. 4, the main portion 44 has no groove 128.

On the back face 50 and the bottom face 52 of each side portions 46, there are provided a nib 54 and a nib 56, respectively, for correct positioning of the pin header 30 on a printed circuit board (not shown in FIG. 3).

Each one end 58 of the pins 34 projects perpendicularly from the front face 36 of the main body 32 in two parallel straight rows. The distance between these two rows, the distance between any two adjacent pins in each row, the distance of the portion of each pin projecting from the front face 36 of the main body 32, etc. are made so as to connect with conventional female connectors (receptacles). Therefore, as necessary the one ends 58 of the pins 34 can be arranged in one straight row or three or more parallel straight rows. In this embodiment, the one ends 58 of the pins 34 are arranged in parallel straight rows not only in the lengthwise direction of the pin header 30 but also in a direction perpendicular to said lengthwise direction. However, this arrangement is not always necessary and the one ends 58 can be arranged so as to form parallel straight rows only in the lengthwise direction of the pin header 30.

Each other end 60 of the pins 34 projects from the back face 38 of the main portion 44 opposing the front face 36 in one straight row, is bent downward, extends along the back face 38, and is bent at right angles so as to extend along the bottom face 42 of the main portion 44 and terminates. Therefore, each other end 60 of the pins 34 has a subportion parallel to the one end 58, namely, a subportion along the bottom face 42 and a subportion perpendicular to the one end 58, namely, a subportion along the back face 38. The outer face of the subportion of each other end 60 along the back face 38 and the back face 50 of each side portion 46 are substantially on one same plane. The outer face of the subportion of each other end 60 along the bottom face 42 and the bottom face 52 of each side portion 46 are substantially on one same plane.

Thus, in this pin header 30, the pins 34 form two parallel straight rows at the one ends 58 and one straight row at the other ends 60. Therefore, the pins are bent within the main body 32. Such a pin header 30 can be produced according to, for example, insert molding.

This pin header 30 can be surface-mounted on a printed circuit board (not shown in FIG. 3) according to, for example, the following reflow soldering method.

The printed circuit board has holes corresponding to the positioning nibs 54 and 56. The printed circuit board further has, on its surface, linear conductor films corresponding to the other ends 60 of the pins 34. A liquid containing solder is coated on these linear conductor films. The pin header 30 is correctly mounted on the printed circuit board by the help of the positioning nibs 54 or 56 and the corresponding holes of the printed circuit board. The pin header 30 and the printed circuit board are heated, whereby each other end 60 of the pins 34 is soldered to each corresponding linear conductor film.

When the positioning nibs 54 are fitted with the corresponding holes of the printed circuit board, each one end 58 of the pins 34 extends perpendicularly to the surface of the printed circuit board. Meanwhile, when the positioning nibs 56 are used, each one end 58 of the pins extend parallel to the surface of the printed circuit board.

In the embodiment of FIG. 3, the one ends 58 of the pins 34 form two parallel straight rows and the other ends 60 project from the back face 38 of the main portion 44 in one straight row. This arrangement is preferable because pins of the same length can be used. The pin header 30 of FIG. 30 can be produced by conducting insert molding so that each other end 60 of the pins 34 projects perpendicularly from the back face 38 of the main portion 44 and then by simply bending the other ends 60 as shown in FIG. 3.

Alternatively, the pin header 30 can be constituted so that the other ends 60 of the pins 34 project from the back face 38 of the main portion 44 in a plurality of parallel straight rows. In this case, in order to prevent mutual contact between pins at the time of bending operation, the other ends 60 of the pins 34 are arranged in such a way that only one pin of any row is present on a straight line perpendicular to the parallel straight rows of the pins.

In the embodiment of FIG. 3, the other ends 60 of the pins 34 project from the back face 38 of the main portion 44. Alternatively, the pin header 30 can be constituted, for example, so that the other ends 60 of the pins 34 project from the bottom face 42 of the main portion 44, extend along the bottom face 42, further extend along the back face 38 and terminate.

In the embodiment wherein the one ends 58 of the pins 34 are arranged in two parallel straight rows, it is possible that the other ends 60 of the first row pins 34 project from the back face 38 of the main portion 44, extend along the back face 38, further extend along the bottom face 42 and terminate and the other ends 60 of the second row pins 34 project from the bottom face 42 of the main portion 44, extend along the bottom face 42, further extend along the back face 38 and terminate.

The fourth embodiment of the present invention will be explained by referring to FIG. 4.

Figure 4:
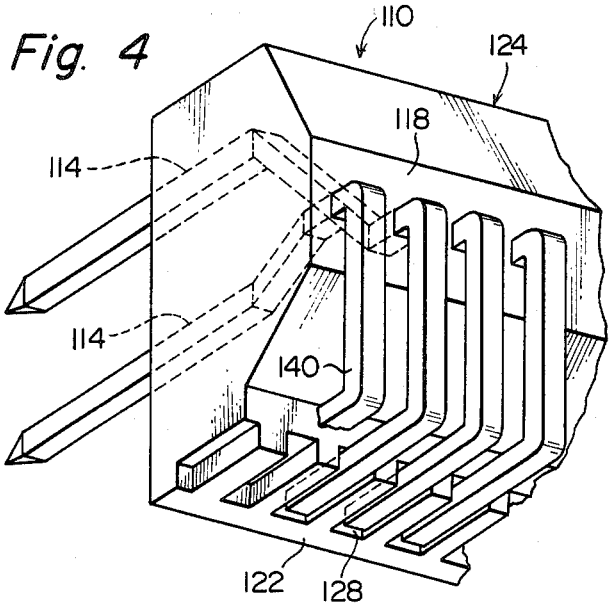
FIG. 4 is a key portion perspective view of a pin header according to the fourth embodiment of the present invention.

In the pin header 110 shown in FIG. 4, the other ends 140 of the pins 114 extend from the back face 118 of the main portion 124 to the bottom face 122 of the main portion 124, and the final ends of the other ends 140 are accomodated in the grooves 128 provided in the back face 118. The final ends of the pins 114 are correctly positioned by the grooves 128, whereby shortcircuiting between the pins 114 can be prevented.

It is preferable that the grooves 128 be provided in the bottom face 122 as mentioned above, to correctly position the final ends of the pins 114. However, the grooves can alternatively be provided, for example, so that they support each curved subportion of each other end 140 of the pins 114, located between (1) the subportion of the other end 140 parallel to the back face 118 of the main portion 124 and (2) the subportion of the other end 140 parallel to the bottom face 122 of the main portion 124.

The pin headers of the third and fourth embodiment of the present invention can be used as a pin header whose pins extend perpendicularly to the surface of a printed circuit board, or as a pin header whose pins extend parallel to the surface of the printed circuit board. This can reduce the kinds of parts at users.

In one preferred embodiment, the other ends of the pins project from the main body in one straight row. This makes bending of the other ends easy and accordingly makes pin header production easy.

In other preferred embodiment, the final ends of the other ends of the pins are accomodated by the grooves provided in the main body. This effectively prevents (1) short-circuiting between the other ends of the pins and (2) improper matching between the other ends of the pins and the linear conductor films on a printed circuit board to which the other ends of the pins are to be soldered.

A plug 150 according to the fifth embodiment of the present invention will be explained by referring to FIGS. 5 to 7.

The plug 150 comprises a main body 152 made from a plastic material and a plurality of conductor members 154 made typically from a metallic material.

The main body 152 is defined by a front face 160 having concave portions 158 accommodating the female contacts 156 of the conductor members 154, a back face 162 opposing the front face 162, an upper face 164, a bottom face 166 and two side faces 168.

Figure 6:
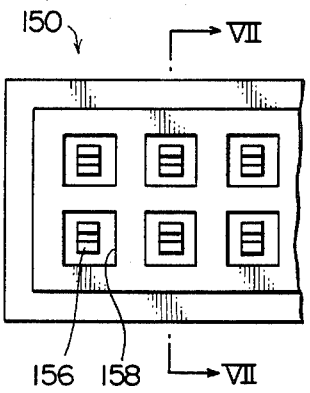
FIG. 6 is a partial front view of the plug of FIG. 5.

The concave portions 158 of the front face 160 are arranged, as shown in FIG. 6, in such a condition that they form two parallel straight rows (an upper row and a lower row) and further one concave portion of one row and one concave portion of the other row are always on a straight line perpendicular to the two parallel straight rows.

Figure 5:
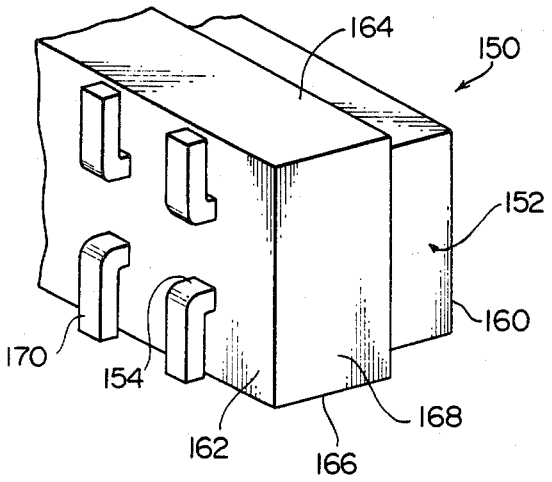
FIG. 5 is a key portion perspective view of a plug according to the fifth embodiment of the present invention.
Figure 7:
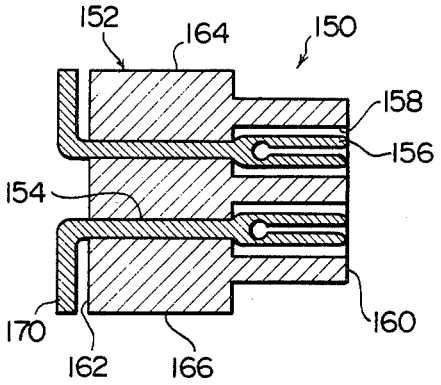
FIG. 7 is a sectional view taken on the line VII—VII of FIG. 6.

Each one end of the conductor members 154 forms the female contact 156 as mentioned above, and each other end forms a terminal portion 170 to be soldered to each one linear conductor film on a printed circuit board (not shown in FIGS. 5 to 7).

The terminal portions 170 of upper row are bent upward and the terminal portions 170 of lower row are bent downward.

This plug can be produced, for example, as follows.

At first, the main body 152 is formed with a plastic material in a shape as shown in FIG. 5 to 7.

Next, the conductor members 154 each having a female contact 156 and a terminal portion 170 are driven into the main body 152 from, for example, the terminal portion 170 side of the main body 152, whereby the female contacts 156 are accomodated by the concave portions 158 of the main body 152 and the terminal portions 170 are parpendicularly projected from the back face 162 of the main body 152. Thereafter, the terminal portions 170 of upper row are bent upward and the terminal portions 170 of lower row are bent downward.

The plug 150 produced as above is surface-mounted on a printed circuit board (not shown) according to, for example, the reflow soldering method.

A plug 210 of the sixth embodiment of the present invention will be explained by referring to FIGS. 8 to 10.

This plug 210 is different from the plug 150 of the fifth embodiment in the arrangement of the concave portions 218. That is, in the plug 210 of the sixth embodiment, the concave portions 218 provided in the front face 220 of the main body 212 are arranged zigzag, more particularly in such a condition that they form two parallel straight rows (an upper row and a lower row) and further any two adjacent concave portions of one row and a concave portion of the other row nearest to said two adjacent concave portions always form an equilateral triangle.

The plug 210 of the sixth embodiment is produced and mounted on a printed circuit board in the same manner as for the plug 150 of the fifth embodiment.

A plug 310 of the seventh embodiment of the present invention will be explained by referring to FIG. 11.

The Plug 310 of the seventh embodiment differs from the plug 210 of the fifth embodiment in the shape of the terminal portions 330.

In the plug 310, as in the plug 210 of the fifth embodiment, the concave portions provided in the front face 320 of the main portion 312 are arranged zigzag. In the plug 310, however, both the terminal portions 330 of upper row and the terminal portions 330 of lower row are bent downward and then extend slightly in a direction parallel to the bottom face 326 of the main body 312 and moving away from the main body 312. The bottom face of the subportion 332 of each terminal portion 330 parallel to the bottom face 326 of the main body 312 and the bottom face 326 of the main body 312 is on one same plane.

The plug 310 can be produced in the same manner as used in the fifth embodiment.

The plug 310 is placed on a printed circuit board so that the bottom face of each subportion 332 of the terminal portions 330 parallel to the bottom face 326 of the main body 312 is mounted on each linear conductor film on the printed circuit board, and then the subportions 332 and the linear conductor films on the printed circuit board are soldered.

Figure 12:
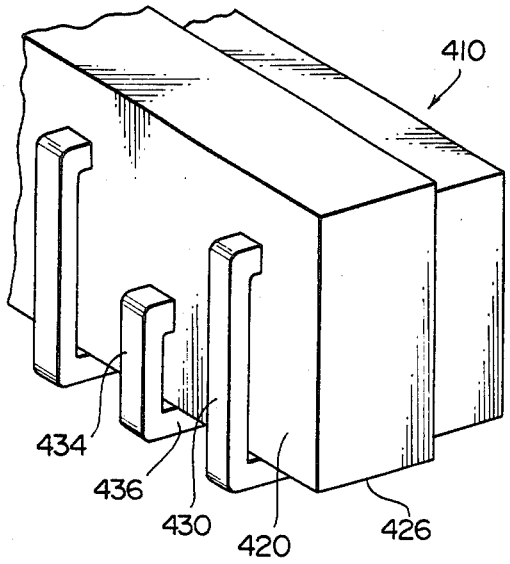
FIG. 12 is a key portion perspective view of a plug according to the eighth embodiment of the present invention.
Figure 14:
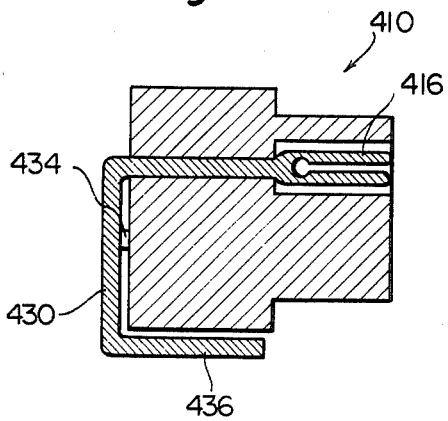
FIG. 14 is a sectional view taken along the line XIV—XIV of FIG. 13.
Figure 13:
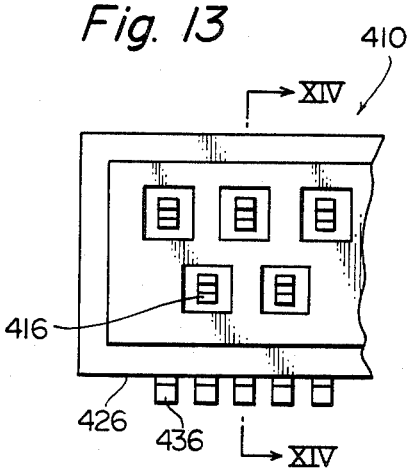
FIG. 13 is a partial front view of the plug of FIG. 12.

A plug 410 of the eighth embodiment will be explained by referring to FIGS. 12 to 14.

The plug 410 differs from the plugs 210 and 310 of the sixth and seventh embodiments, respectively, in the shape of the terminal portions 430.

In the plug 410, the terminal portions 430 project from the back face 420 of the main body in two rows (an upper row and a lower row), are bent downward to each form a subportion 434 parallel to the back face 420, are further bent at right angles to each form a subportion 436 parallel to the bottom face 426 of the main body and terminate.

The plug 410 can be produced in the same manner as used for the plugs 150, 210 and 310.

The plug 410 can be mounted on a printed circuit board in two different arrangements. As mentioned above, each terminal portion 430 of the plug 410 has a subportion 434 parallel to the back face 420 of the main body and a subportion 436 parallel to the bottom face 426 of the main body. Therefore, the plug 410 can be soldered to the linear conductor films of the printed circuit board, at the subportions 434 or at the subportions 436. When the plug 410 is soldered at the subportions 434, the plug 410 is arranged on the printed circuitboard so that the female contacts 416 of the plug 410 extend perpendicularly to the surface of the printed circuit board. When the plug 410 is soldered at the subportion 436, the plug 410 is arranged on the printed circuit board so that the female contacts 416 of the plug 410 extend parallel to the surface of the printed circuit board.

In the above sixth to eighth embodiments, the female contacts are arranged zigzag. Therefore, the terminal portions arranged in two parallel straight rows do not cause mutual contact when they are bent in one same direction, for example, downward. Since the male contacts of conventional headers are arranged in such a condition that the contacts form straight lines in both the direction of their rows and a direction perpendicular to the rows, any header to be connected to the plugs of the sixth to eighth embodiments must be produced in a special design so as to conform to the plugs.

In the plug 150 of the fifth embodiment, the female contacts 156 are arranged in such a condition that the contacts 156 form stright lines in both the direction of their rows and a direction perpendicular to the rows. Therefore, the plug can be connected to conventional headers. However, since the female contacts are arranged as mentioned above, bending of the terminal portions 170 of two rows in one same direction without mutual contact needs a special operation. For example, the terminal portions 170 of lower row are bent downward as they are, and the terminal portions 170 of upper row are firstly bent slightly in the lengthwise direction of the main body 152 (left to right direction in FIG. 6) and then are bent downward between the terminal portions 170 of lower row. Such a bending operation is relatively complicated.

The next embodiment has been prepared by taking the above situation into consideration.

A plug 510 of the nineth embodiment will be explained by referring to FIGS. 15 to 17.

The plug 510 comprises a main body 512 made from a plastic material and a plurality of conductor members 514.

The main body 512 is defined by a front face 520 having the concave portions 518 accomodating the female contacts 516 of the conductor members 514, a back face 522 opposing the front face 520, an upper face 524, a bottom face 526 and two side faces 528.

The concave portions 518 of the front face 520 are arranged so that they form two straight upper and lower rows and further one concave portion of upper row and one concave portion of lower row are always on one same straight line perpendicular to the rows.

Each one end of the conductor members 514 has the female contact 516 as mentioned above and each other end has a terminal portions 530 to be soldered to each one linear conductor film on a printed circuit board (not shown). As shown in FIGS. 15 and 17, the conductor members 514 are curved within the main body 514 between the female contacts 516 and the terminal portions 530, and the terminal portions 530 project from the back face 522 of the main body 512 in one straight row.

The plug 510 can be produced, for example, by (1) subjecting a main body 512 and conductor members 514 whose intermediate portions are curved, to insert molding, (2) bending the terminal portions 530 of the conductor members 514 so as to become parallel to the back face 522 of the main body 512 and (3) further bending so as to become parallel to the bottom face 526 of the main body 512.

As in the case of the plug 410 of the eighth embodiment, the plug 510 can be arranged on a printed circuit board in two forms, that is, in one form wherein the female contacts 516 extend perpendicularly to the printed circuit board or in the other form wherein the female contacts 516 extend parallel to the surface of the printed circuit board.

A plug 610 of the tenth embodiment will be explained by referring to FIG. 18.

The plug 610 differs from the plug 510 of the nineth embodiment, in that the main body 612 of the plug 610 has grooves 638 accomodating the final ends of the terminal portions 630 of the conductor members 614. By providing these grooves 638, there occurs no contact between terminal portions 630 even when an outside pressure is applied to the portions.

The plugs of the fifth to tenth embodiments of the present invention can be correctly arranged on a printed circuit board without making holes in the printed circuit board.

In a preferred embodiment, these plugs can be used as a plug whose female contact extend perpendicularly to the surface of a printed circuit board, or as a plug whose female contacts extend parallel to the surface of the printed circuit board. This can reduce the kinds of parts at users.

Also in a preferred embodiment, the terminal portions project from the main body in one straight row. This makes bending of the terminal portions easy and makes plug production easy.

In other preferred embodiment, the final ends of the terminal portions are accomodated by the grooves provided in the main body. This effectively prevents (1) short-circuiting between conductors and (2) improper matching between the terminal portions and the linear conductor films on a printed circuit board to which the terminal portions are to be soldered.

Figure 19:
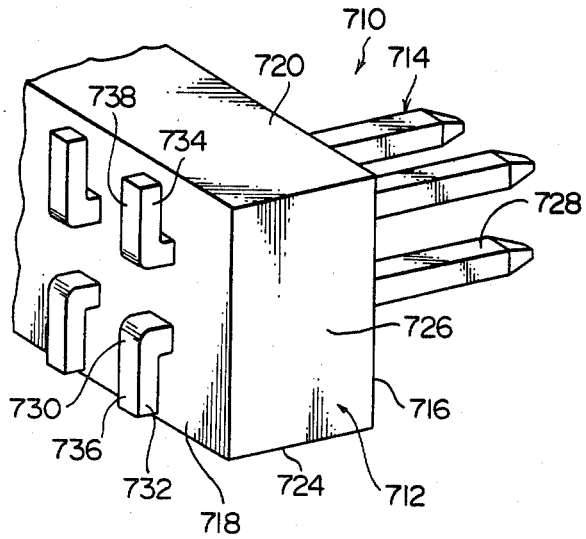
FIG. 19 is a key portion perspective view of a header produced according to one preferred embodiment process of the present invention.
Figure 21:
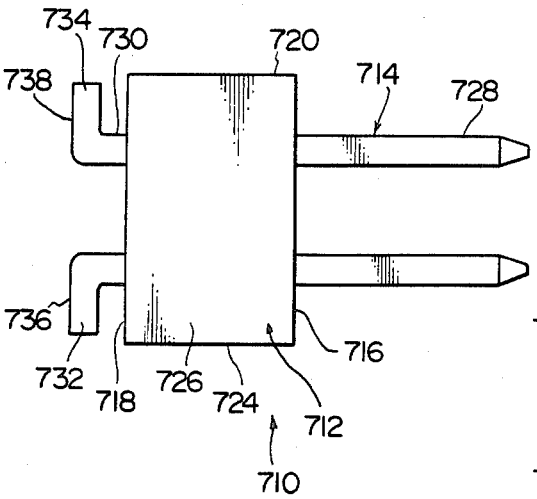
FIG. 21 is a side view of the header of FIG. 19.
Figure 20:
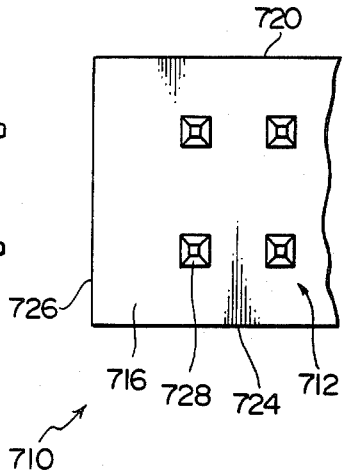
FIG. 20 is a partial front view of the header of FIG. 19.

A process for producing a header according to a preferred embodiment of the present invention will be explained by referring to FIGS. 19 to 21.

A header 710 produced according to this process comprises a main body 712 made from a plastic material and a plurality of conductor members 714 penetrating the main body 712.

The main body 712 has a substantially rectangular and flat front face 716, a back face 718 opposing the front face 716, an upper face 720, a bottom face 724 and two side faces 726 (only one side face is shown).

Each one end 728 of the conductor members 714, namely, each male contact projects perpendicularly from the front face 716 of the main body 712 in two rows (an upper row and a lower row). The distance between these two rows, the distance between two adjacent male contacts in each row, the length of each male contact projecting from the front face 716, etc. are made so as to conform to the shape of conventional plugs. Therefore, as necessary, the one ends 728 of the conductor members 714 can be arranged in one row or three or more rows.

In this embodiment, the conductor members 714 are driven into the main body 712 in such a condition that the conductor members 714 form straight lines in both the lengthwise direction of the main body 712 (left to right direction in FIG. 20) and a direction perpendicular to the lengthwise direction of the main body 712.

Each other end 730 of the conductor members 714, namely, each terminal portion projects perpendicularly from the back face 718 of the main body 712 opposing the front face 716, in two rows at the positions corresponding to those of each one end 728. As shown in FIGS. 19 and 21, each other end 730 of lower row terminates at a subportion 732 extending downward, and each other end 730 of upper row terminates at a subportion 734 extending upward. The outer faces 736 of the subportions 732 and the outer faces 738 of the subportions 734 are substantially on one same plane.

According to this embodiment, the header 710 can be produced as follows.

At first, a main body 712 is produced with a plastic material.

Then, linear conductor members 714 are driven into the main body 712. Each one end 728 of the conductor members 714 is kept straight. Each other end 730 of the lower row of the conductor members 714 is bent downward so as to be parallel to the back face 718 of the main body 712. Each other end 730 of the upper row of the conductor members 714 is bent upward so as to be parallel to the back face 718 of the main body 712.

The thus produced header 710 is surface-mounted on a printed circuit board (not shown) according to, for example, the reflow soldering method.

In the above arrangement, each one end 728 of the header 710, namely, each male contact extends perpendicularly to the surface of the printed circuit board.

Other embodiment process of the present invention will be explained by referring to FIGS. 22 to 24.

A header 760 produced according to this process differs from the header 710 in the positions where the conductor members 764 are driven.

Figure 22:
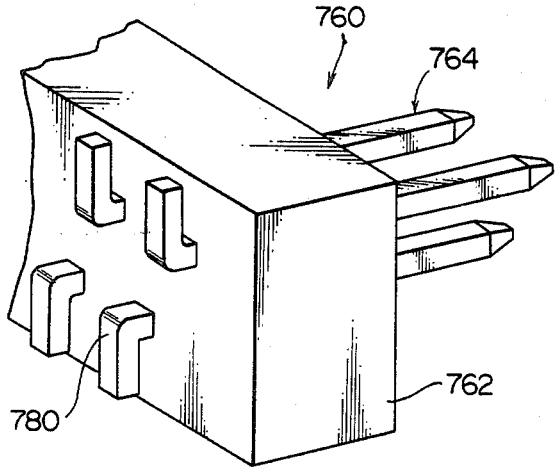
FIG. 22 is a key portion perspective view of a header produced according to other embodiment process of the present invention.
Figure 24:
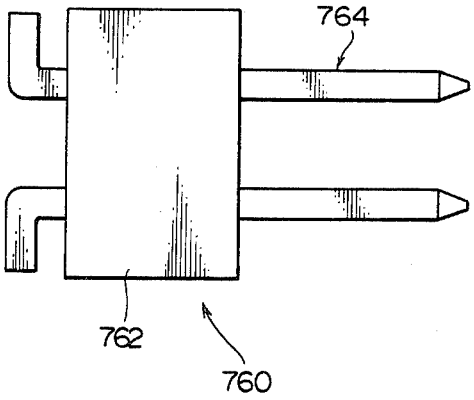
FIG. 24 is a side view of the header of FIG. 22.
Figure 23:
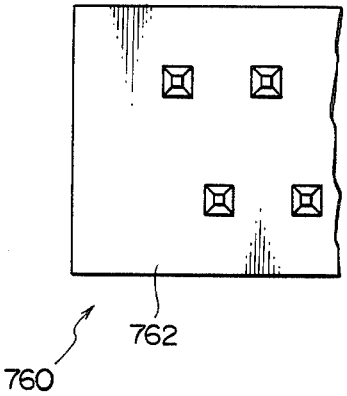
FIG. 23 is a partial front view of the header of FIG. 22.

As shown in FIGS. 22 to 24, in the header 760, the conductor members 764 are driven into zigzag, more particularly in such a condition that they form two parallel straight rows (an upper row and a lower row) in the lengthwise direction of the main body 762 (left to right direction in FIG. 23) and further any two adjacent conductor members of one row and one conductor member of the other row nearest to said two adjacent conductor members always form a triangle such as an equilateral triangle.

The header 760 is produced as follows according to this embodiment.

At first, a main body 762 is produced with a plastic material.

Then, conductor members 764 are driven into the main body 762 zigzag, more particularly in such a condition that they form two parallel straight rows and further any two adjacent conductor members of one row and one conductor member of the other row nearest to said two adjacent conductor members always form a triangle such as an equilateral triangle. Thereafter, each second end 780 of the conductor members 764 of lower row is bent downward and each end 780 of thne conductor members 764 of upper row is bent upward.

The header 760 is arranged on a printed circuit board in the same manner as used for the header 710.

A header 810 produced according to other embodiment process of the present invention will be explained by referring to FIGS. 25–27.

The header 810 differs from the header 760 in the shape of second ends 830, namely, terminal portions.

In the header 810, conductor members 814 are driven into a main body 812 zigzag as in the header 760. Each first end 828 of the conductor members 814 projects perpendicularly from the front face 816 of the main body 812, as in the header 760. Each second end 830 of the conductor members 814 of both upper and lower rows extend downward along the back face 818 of the main body 812, are bent at right angles so as to form a subportion 834 extending parallel to the bottom face 822 of the main body 812 and terminates. The bottom face of the subportion 834 and the bottom face 822 of the main body 812 are substantially on one same plane.

Figure 25:
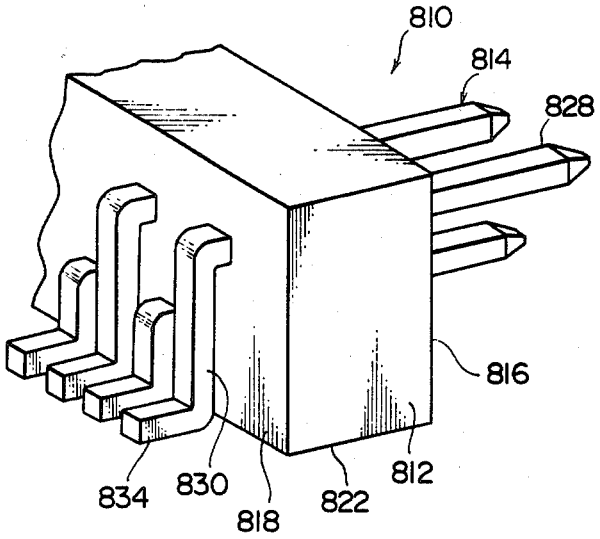
FIG. 25 is a key portion perspective view of a header produced according to other embodiment process of the present invention.
Figure 27:
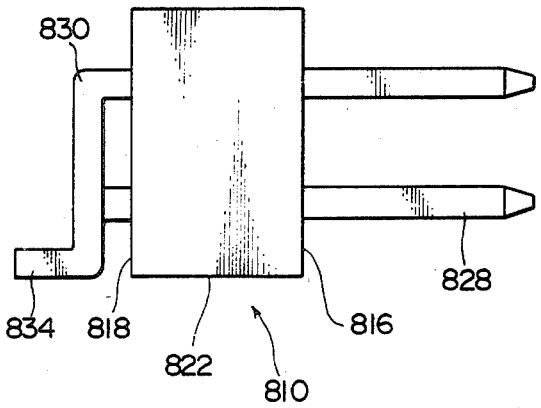
FIG. 27 is a side view of the header of FIG. 25.
Figure 26:
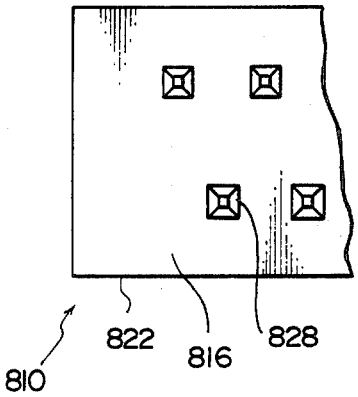
FIG. 26 is a partial front view of the header of FIG. 25.

In this embodiment, a header 810 is produced by forming a main body 812 in the same manner as in the case of the header 710, driving conductor members 814 into the main body 812 and bending each second end 830 of the conductor members 814 as shown in FIGS. 25 and 27.

The header 810 is arranged on a printed circuit board so that the first ends 828 of the conductor members 814, namely, the male contacts become parallel to the surface of printed circuit board. That is, the header 810 and the printed circuit board are combined in such a condition that the bottom surface 822 of the main body 812 is on the surface of the printed circuit board and each subportion 834 of the conductor members 814 parallel to the bottom face 822 of the main body 812 matches each corresponding conductor portion of the printed circuit board. Then, the header 810 and the printed circuit board are soldered according to, for example, the reflow soldering method.

Thus, the header 810 is arranged on the printed circuit board in such a condition that the first ends 828 of the conductor members 814 are parallel to the surface of the printed circuit board.

Figure 28:
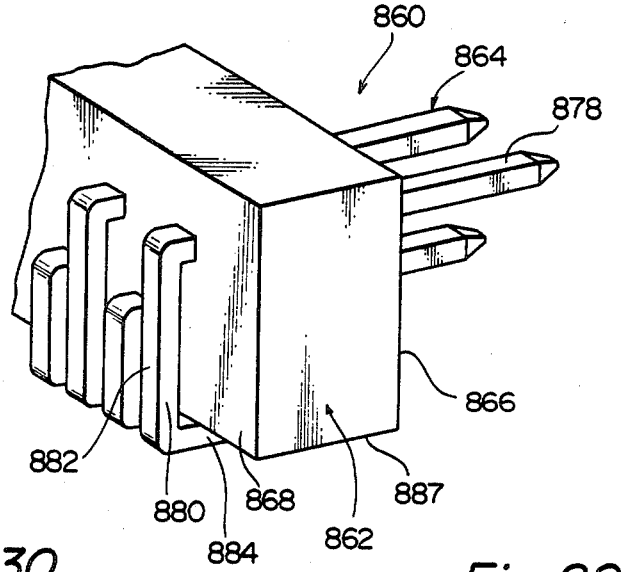
FIG. 28 is a key portion perspective view of a header produced according to other embodiment process of the present invention.
Figure 30:
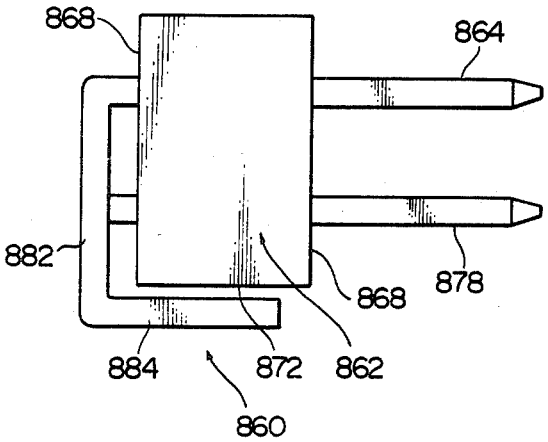
FIG. 30 is a side view of the header of FIG. 28.
Figure 29:
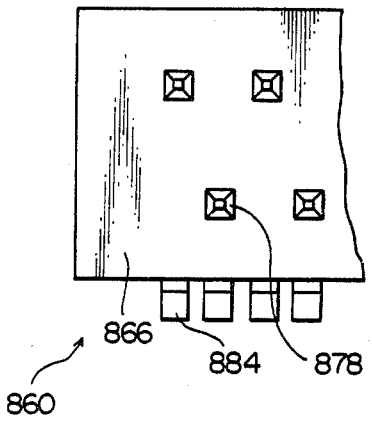
FIG. 29 is a partial front view of the header of FIG. 28.

A header 860 produced according to other embodiment process will be explained by referring to FIGS. 28 to 30.

The header 860 differs from the headers 870 and 810 in the shape of second ends 880, namely, terminal portions.

In the header 860, conductor members 864 are driven into a main body 862 zigzag, as in the headers 760 and 810. The first ends 878 of the conductor members 864 project perpendicularly from the front face 866 of the main body 862, as in the headers 760 and 810. The second ends 880 of the conductor members 864 of both upper and lower rows extend downward along the back face 868 of the main body 862 to each form a subportion 882 parallel to the back face 868, are bent at right angles toward below the bottom face 872 of the main body 862 to each form a subportion 884 parallel to the bottom face 872, and terminate. The outer faces, namely, the back faces of the subportions 882 are parallel to the back face 868 of the main body 862, and the bottom faces of the subportions 884 are parallel to the bottom face 872 of the main body 862. According to this embodiment, a header 860 is produced by forming a main body 862 in the same manner as in the above embodiments, driving conductor members 864 into the main body 862, and bending the second ends 880 of the conductor members 864 as shown in FIGS. 28 and 30.

The header 860 can be arranged on a printed circuit board in such a condition that the first ends of the conductor members, namely, the male contacts become perpendicular or parallel to the surface of the printed circuit board.

That is, when each subportion 882 of the conductor members 864 parallel to the back face 868 of the main body 862 is soldered to each corresponding conductor portion of a printed circuit board, the first ends 878 of the conductor members 864 become perpendicular to the surface of the printed circuit board. When each subportion 884 of the conductor members 864 parallel to the bottom face 872 of the main body 862 is soldered to each corresponding conductor portion of the printed circuit board, the first ends 878 of the conducotr members 864 become parallel to the surface of the printed circuit board.

Figure 31:
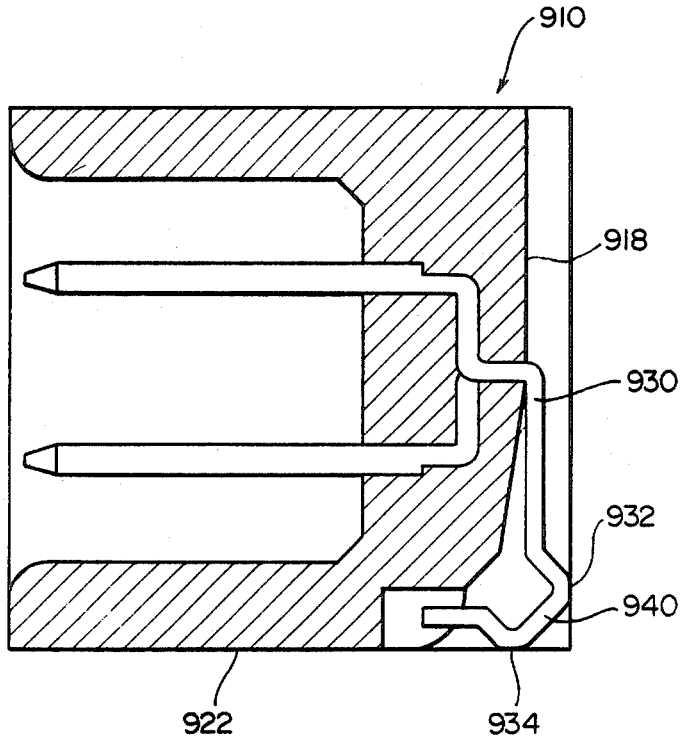
FIG. 31 is a key portion sectional view of a header according to other embodiment of the present invention.

Referring to FIG. 31, a header 910 according to other embodiment will be explained.

In this header 910, the terminal portion 930 of the conductor member consists of a subportion parallel to the back face 918 of the header, a curved subportion 940 and a subportion parallel to the bottom face 922 of the header. By forming the terminal portion in such a structure, soldering condition when the header is soldered to a printed circuit board at the corner 932 or 934 of the surved subportion 940 can be ascertained visually.

Such a terminal structure having the curved subportion 940 can be applied also to a plug.

Thus, according to the process of the present invention, there can suitably be produced a header comprising a main body made from a plastic material and a plurality of conductor members penetrating the main body, each one end of the conductor members forming a male connector, and each other end of the conductor members forming a terminal portion to be connected to each one conductor on a printed circuit board.

In one preferred embodiment, there can be produce a header which can be used in such a condition that its conductor members extend perpendicularly or parallel to the surface of a printed circuit board depending upon choice.

In other preferred embodiment, conductor members are driven into a main body so as to be arranged zigzag. This makes the bending operation of the conductor members easier.

What is claimed is:

1. An electric connector for elelctrically connecting between an electric element and conductors on a planar surface of a printed circuit board, comprising a plastic main body and a plurality of conductor members penetrating the main body, each of the conductor members having at one end a connecting portion for connecting to the electric element and at the other end a terminal portion for connecting to said one conductor on the printed circuit board, each terminal portion of the conductor members having a first face which is subject to surface mounting contact with one of said conductors on the printed circuit baord when the electric connector is arranged on the printed circuit board with each connecting portion of the conductor members extending parallel to the printed circuit board and a second face which is subject to surface mounting contact with one of said conductors on the printed circuit board when the electric connector is arranged on the printed circuit board with each connecting portion of the conductor members extending perpendicularly to the printed circuit board, said main body having a plurality of grooves in a surface thereof, the ends of the terminal portions of the conductor members being seated in said grooves.

2. An electric connector according to claim 1 which is a pin header.

3. An electric connector according to claim 1 which is a plug.

4. An electric connector according to claim 1, wherein at least some of the conductor members are bent within the main body.

5. An electric conenctor according the claim 4, wherein the main body is substantially a rectangular parallelepided and the conductor members enter the main body at one face in two parallel straight rows, penetrate the main body and extend to an other face of the main body opposing said one face.

6. An electric connector according to claim 5, wherein the conductor members leave the main body at the other face in one straight row.

7. An electric connector according to claim 5, wherein the conductor members leave the main body at the other face in two parallel straight rows.

8. An electric connector according to claim 3, wherein the connecting portions are female contacts and the main body has at one face concave portions for accomodating the female contacts.

9. An electric connector according to claim 8, wherein the concave portions are arranged in a plurality of parallel stright rows.

10. An electric connector according the claim 8, wherein the concave portions are arranged in a plurality of parallel straight rows and yet in a zigzag pattern.

11. An electric connector according to claim 8, wherein the terminal portions are arranged in a plurality of parallel straight rows and bent in one same direction.

12. An electric connector according to claim 8, wherein intermediate portions between said ends of the conductor members are bent within the main body and the terminal portions project from the main body in one straight row.

13. An electric connector according to claim 8, wherein intermediate poritons between said ends of the conductor members are bent within the main body and the terminal portions project from the main body in a zigzag arrangement.

* * * * *